US006450316B1

(12) United States Patent
Stuffel et al.

(10) Patent No.: US 6,450,316 B1
(45) Date of Patent: Sep. 17, 2002

(54) ESCALATOR WITH STEP FLANGE

(75) Inventors: Andreas Stuffel, Porta Westfalica (DE); Frank Sansevero, Glastonbury; Richard Fargo, Plainville, both of CT (US); Jörg Ostermeier, Bückeburg; Uwe Hauer, Nienburg, both of (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/724,090

(22) Filed: Nov. 28, 2000

(51) Int. Cl.[7] ..... B66B 21/00; B66B 21/02; B66B 23/12

(52) U.S. Cl. ..... 198/326; 198/198; 198/333; 198/327

(58) Field of Search ..... 198/332, 333, 198/326, 327

(56) References Cited

U.S. PATENT DOCUMENTS 3,986,595 A * 10/1976 Asano et al. ..... 198/333 X
4,470,497 A 9/1984 Kraft
4,519,490 A * 5/1985 White ..... 198/333
4,638,901 A 1/1987 Lunardi
4,726,463 A 2/1988 Babler
5,242,042 A * 9/1993 Mauldin ..... 197/333
5,560,468 A * 10/1996 Inoue ..... 198/333
5,695,040 A * 12/1997 Watanabe et al. ..... 198/333
6,213,278 B1 * 4/2001 Tanigawa ..... 198/333 X

FOREIGN PATENT DOCUMENTS

DE 23 46 266 3/1975
DE 199 25 399 12/1999

* cited by examiner

*Primary Examiner*—Christopher P. Ellis
*Assistant Examiner*—Gene O. Crawford

(57) ABSTRACT

An escalator system includes a protective flange assembly along edges of the steps having step flanges. In one example, a first step flange member is adjacent each edge of each step and moves with the step along the escalator path. The first panel member remains stationary relative to the step along the entire path. A second panel member is associated with a corresponding link in the drive chain and remains stationary relative to the link along the entire path of the escalator. The first panel members and second panel members cooperate to provide a continuous barrier along each edge of the steps along the escalator path.

23 Claims, 5 Drawing Sheets

ESCALATOR WITH STEP FLANGE

BACKGROUND OF THE INVENTION

This invention generally relates to passenger conveyor systems. More particularly, this invention relates to a step flange arrangement for an escalator where the step flange moves with the steps of the escalator.

Conventional passenger conveyors, such as escalators, include a chain of steps that travel in a loop to provide a continuous movement along a specified path. There is inherently relative motion between the moving steps and the stationary structure of the conveyor system. Such relative motion is most extreme near landings of escalators, which are transition zones at which the steps move relative to the stationary system structure and relative to each other.

One issue presented by passenger conveyor systems is the possibility for objects being caught between the moving steps and the stationary system structure. This possibility is greatest at transition zones such as near landings.

Various attempts have been made at minimizing or eliminating the possibility for objects to become caught at the interface between moving parts in an escalator system. Stationary skirt panels do not eliminate relative motion although they do cover some of the elevator system components. Movable skirt panels have been proposed, but none have been successfully implemented in the marketplace. An example is shown in U.S. Pat. No. 4,470,497, which has a two-piece skirt guard arrangement that has not proven successful in the marketplace.

There is a need for an arrangement that guards against the possibility for objects to become caught or entrapped at the interface of moving parts in an escalator system. This invention addresses that need in a manner that is superior to previously attempted arrangements.

SUMMARY OF THE INVENTION

In general terms, this invention is an escalator system with a step flange. A first flange panel member is associated with each step such that the first panel member remains stationary relative to the step throughout the movement of the step. A second flange panel member is associated with each link of the drive chain such that the second panel member remains stationary relative to the link throughout the movement of the link.

In a preferred embodiment, a cover is provided that overlaps at least a portion of the first and second panel members.

Another preferred feature of this invention is that the first panel member has an arcuate surface while the second panel member has a corresponding arcuate surface to interface with that of the first panel member. Further, it is preferable that the first panel member includes a portion that is at least partially received by the second panel member to minimize any spacing at the interface between the first and second panel members.

The various features and advantages of this invention will become apparent to those skilled in the art from the following detailed description of the currently preferred embodiment. The drawings that accompany the detailed description can be briefly described as follows.

DETAILED DESCRIPTION OF A PREFERRED EMBODIMENT

Figure 1:
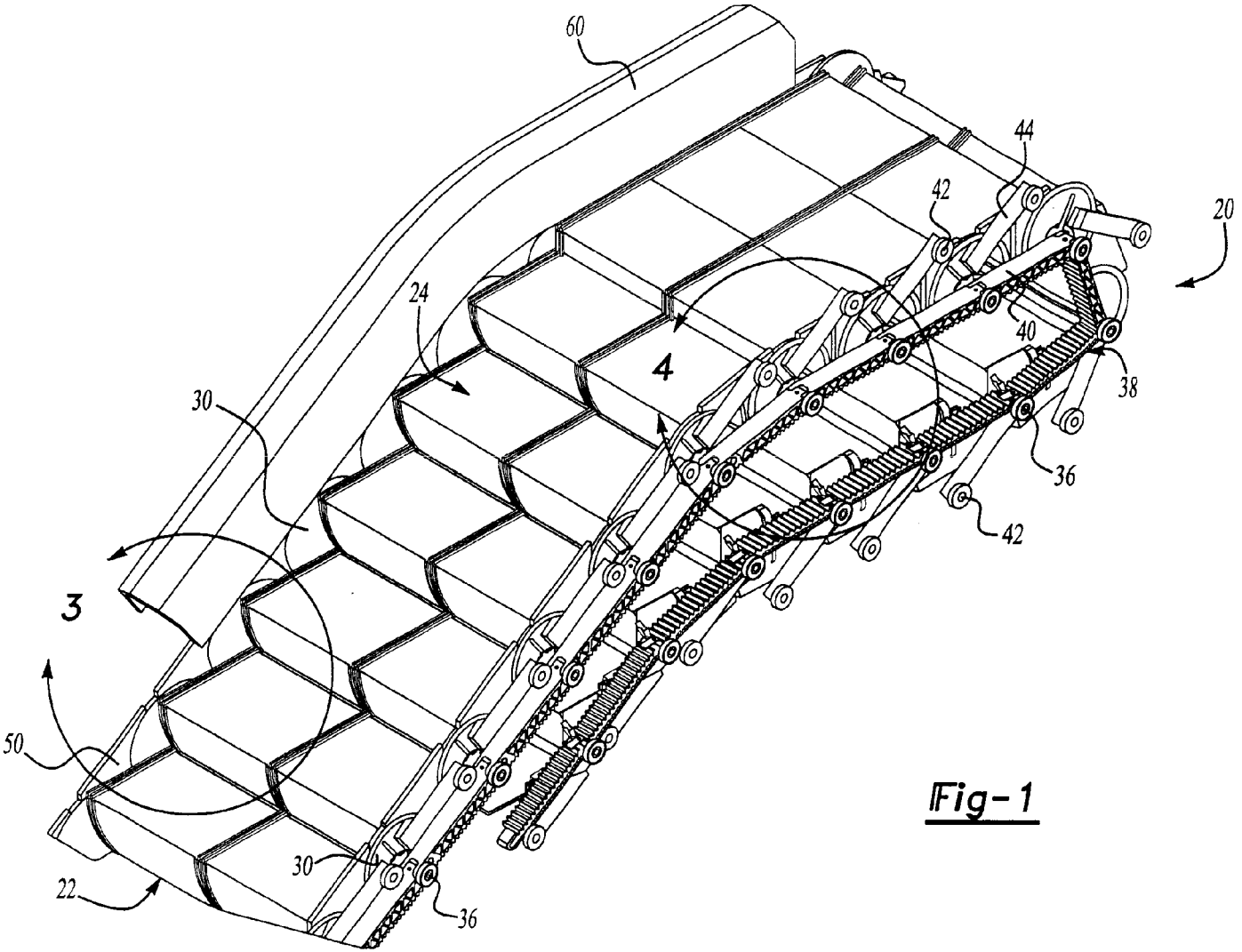
FIG. 1 diagrammatically illustrates portions of an escalator system designed according to this invention.

An escalator system 20 is at least partially shown in FIG. 1. A step chain 22 includes a plurality of steps 24. Each step includes a tread surface 26 and a riser surface 28. The steps 24 preferably are configured to travel in a loop as is conventional in escalator systems. In one example, a conventional drive mechanism is used to cause the steps to move along the loop.

Each step 24 preferably includes a first step flange member 30 adjacent each side edge of the step. The first panel member 30 remains fixed relative to the step 24 so that it travels with the step throughout the movement of the step along the conveyor loop. In one example, the first panel members 30 are rigidly secured to the steps 24 using conventional fastening methods such as bolts or welding. In another example, the first panel members 30 are formed as part of the step 24 when the step is manufactured. Whether the first panel member 30 is made as part of the step 24 or made as a separate piece and secured to the step 24, depends upon the needs of a particular situation. Those skilled in the art who have the benefit of this description will be able to choose accordingly.

The first panel members 30 preferably have an arcuate interface surface 32 along an edge of the panel that is positioned to face in the same direction as the tread surface 26 of the step 24. A hub portion 34 preferably is provided as part of the first panel 30 to accommodate axles 36 of the drive chain 38, which includes a plurality of drive chain links 40.

A drive chain 38 is illustrated for discussion purposes. Other drive members such as a toothed belt are useful in a system designed according to the invention. Those skilled in the art who have the benefit of this description will be able to chose an arrangement to suit their specific needs.

Figure 2:
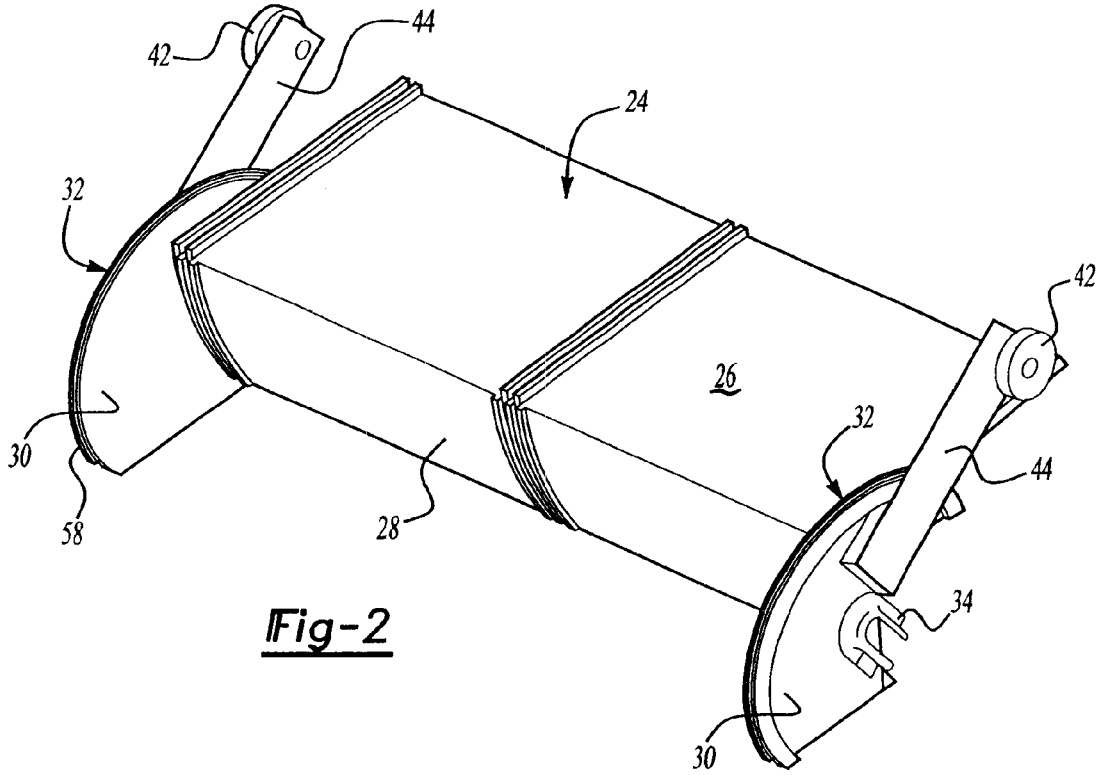
FIG. 2 illustrates a preferred embodiment of a step with a first flange panel member arrangement designed according to this invention.

As best seen in FIG. 2, each first plate member 30 preferably also supports rollers 42 at the ends of roller arms 44. The rollers 42 preferably move along a track that is a portion of the escalator truss structure (not illustrated). The roller arms 44 preferably are rigidly fixed to the first plate members 30.

One advantage associated with an escalator system designed according to this invention is that the rollers 42 are positioned outside of the steps 24 rather than beneath the steps as has been done in the past. This arrangement allows for a more compact step design and provides for more versatility in arranging the corresponding escalator truss track.

Alternative roller arrangements are within the scope of this invention. For example, the embodiment of FIG. 6 includes rollers 42 supported beneath the steps. FIG. 7 shows the rollers 42 beneath the steps supported on arms 44.

The versatility of the roller positions are made possible by another novel feature of this invention, which makes the inventive step flange effective to cover the edges of the steps without requiring multiple moving parts as was done in the prior art.

The traditional way of coupling a step chain to a drive belt or drive chain includes fixing the rear end of the step to the drive chain. The preferred arrangement in this invention includes fixing the front edge of each step 24 to the drive chain 38 rather than the rear end. With the front end attached to the drive chain, the tread portion 26 of the steps moves relative to the step chain as the step chain travels the escalator loop. The greatest height difference between the step tread 26 and the drive chain 38 is during the incline portion of the loop. The smallest height difference occurs at the transition zones and the flat portion.

With the inventive arrangement, in the incline area of the loop a triangular area is bordered by the step tread surface 26, a riser surface 28 of an adjacent step and a line extending between the noses of the steps. That triangular area preferably is covered by a step flange member that remains fixed relative to the drive chain. The fixed distance between step noses, which preferably is the location of the fixing point between the steps and the drive chain, makes it easier to cover the area of concern at the edges of the steps without having the need for multiple moving parts as has been previously thought necessary.

A second step flange member 50 is associated with each drive chain link 40 such that the second panel member 50 remains stationary relative to the drive chain link 40. In other words, each second panel member 50 moves with a drive chain link 40 throughout the movement of the drive chain.

The first and second panel members cooperate along the length of the escalator 20 to provide a step flange assembly along the escalator path. The inventive arrangement minimizes any relative movement at the edges of the steps.

Figure 3:
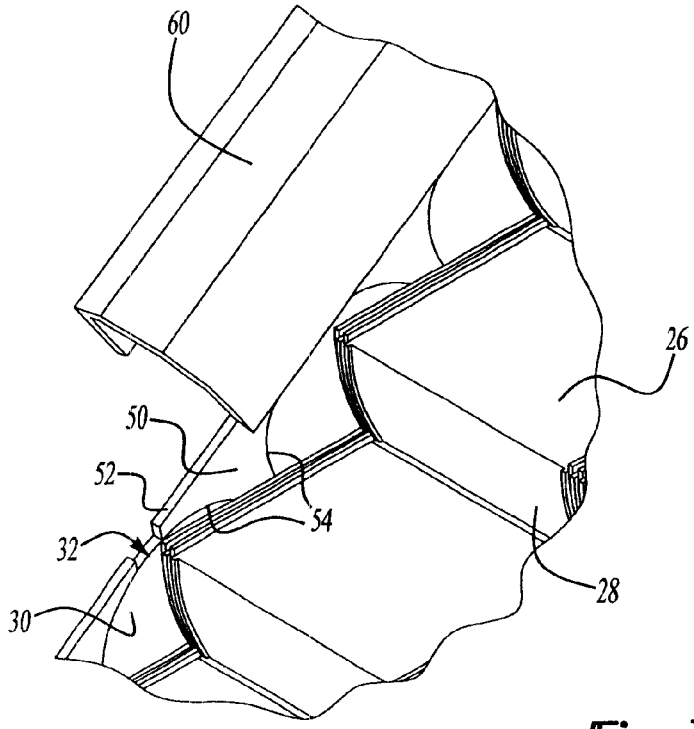
FIG. 3 is a close-up view of the portion in FIG. 1 indicated by the encircled section labeled 3.
Figure 4:
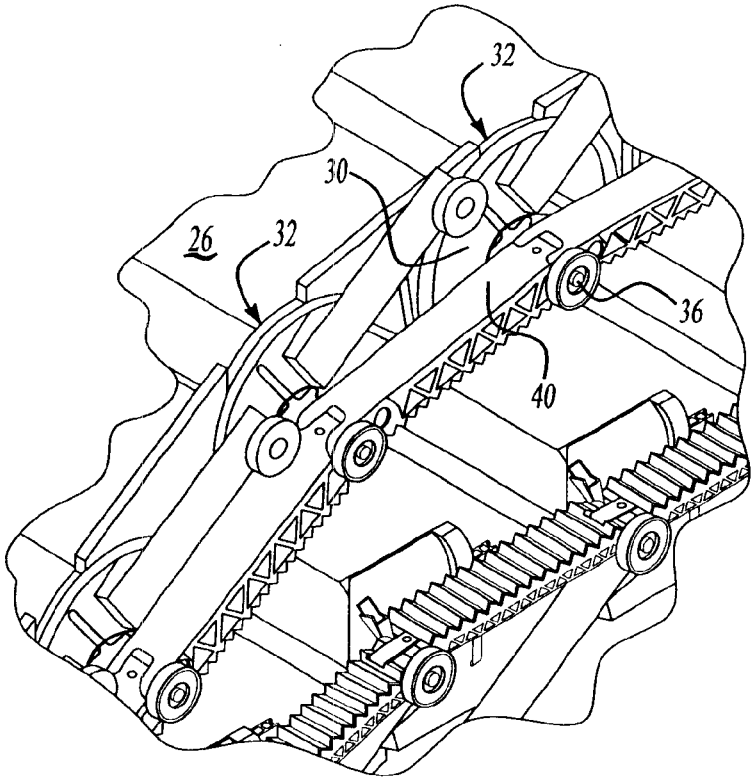
FIG. 4 is a close-up view of the portion of the embodiment of FIG. 1 encircled and labeled 4.

Each second panel member 50 preferably includes a straight top edge 52 that faces in the same direction as the tread surface 26 of each step 24. Two arcuate interface surfaces 54 preferably cooperate with corresponding arcuate surfaces on first panel members 30 as can best be appreciated from FIG. 3. There is some relative movement between the first panel members 30 and the second panel members 50 especially at transition zones in the path of the escalator travel. The potential effects of such relative motion, however, is minimized because of the arrangement and design of the flange assembly of this invention.

Figure 5:
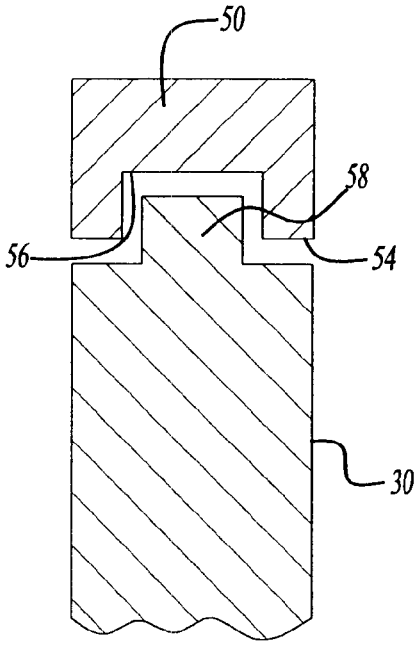
FIG. 5 illustrates a preferred feature of this invention.

As seen in FIG. 5, the second panel members 50 preferably include at least one groove 56 that receives a raised portion 58 on the first panel members 30. Providing such an arrangement minimizes any gap at the interface between first panel members 30 and second panel members 50. The groove and raised portions may be reversed so that the first panel members include the groove.

Further, the preferred arrangement results in relative motion at the edges of the steps 24 parallel to the interface as a result of relative movement between the first panel members 30 and second panel members 50. Such parallel motion minimizes the opportunity for any objects to be drawn into a gap between the panel members. With this invention, relative motion between the steps and panel members is slower, along a shorter distance and at a more closely controlled gap compared to conventional arrangements.

An additional feature of this invention is a cover 60 that is strategically placed so that the top edges 52 and 32 of the panel members are not exposed. As can be appreciated from the drawings, the preferred embodiment includes second panel members 50 that do not extend across the entire top portion of the edge 32 on the first panel members 30. The gaps between adjacent second panel members 50 preferably are not exposed to a passenger on the escalator. The cover 60 can be integrated into the balustrade interior paneling or another portion of the escalator system structure.

At the transition region, the cover 60 preferably is spaced relative to the step surfaces 24 and the panel members to minimize the possibility for pinching or catching a passenger's shoe. In one example, the cover 60 is relatively thin so that it does not extend significantly over the step surface 26 and a passenger's shoe. Additionally, a minimum vertical gap if approximately 25 mm preferably is maintained between a lower edge on the cover 60 and the step surface 26.

This invention provides a significant advantage by having step flange members that remain fixed relative to the steps and drive chain links, respectively. By eliminating any relative motion between the steps and a significant portion of the moving flange, passenger safety is significantly enhanced.

Figure 6:
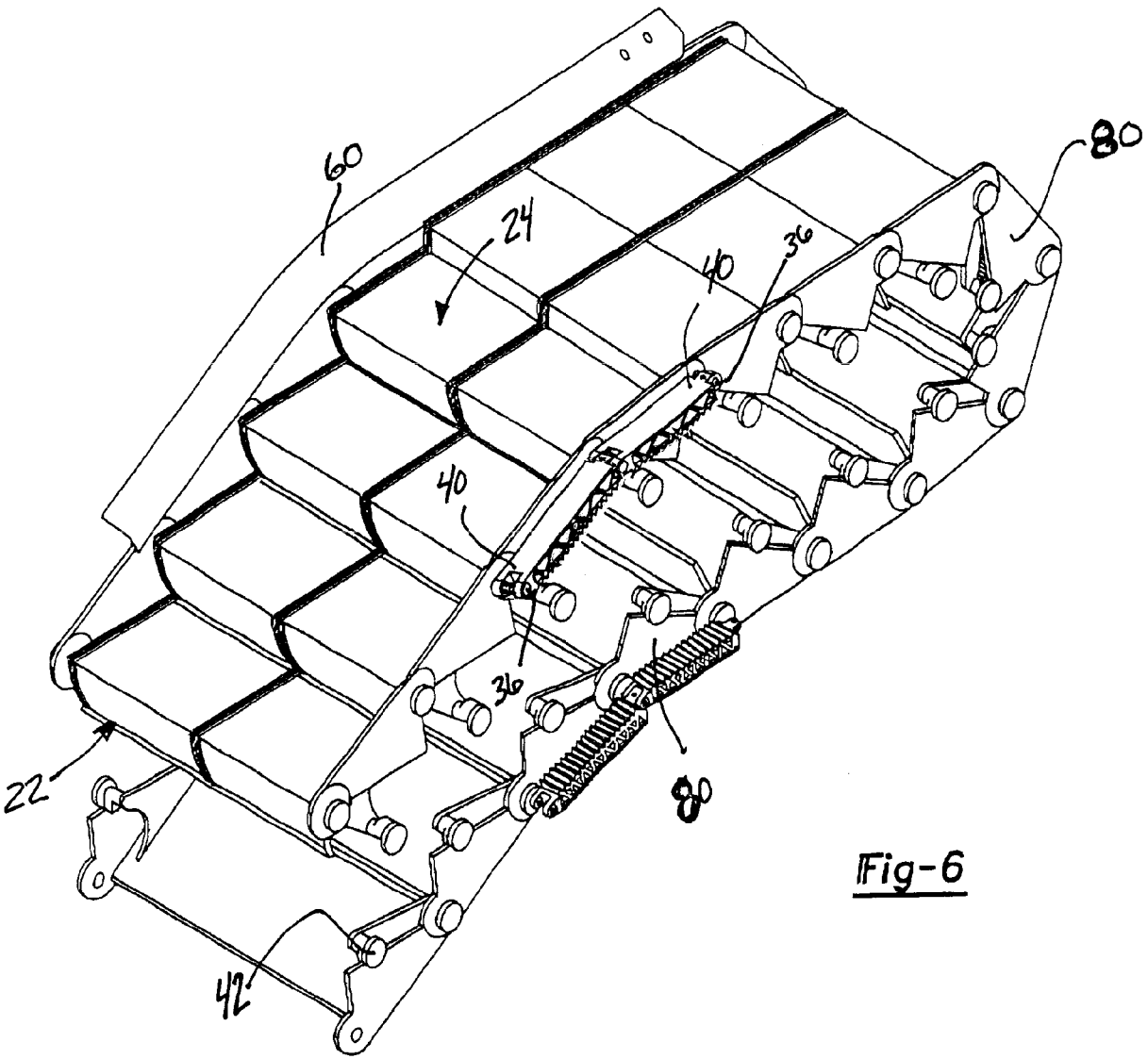
FIG. 6 illustrates another embodiment of this invention.
Figure 7:
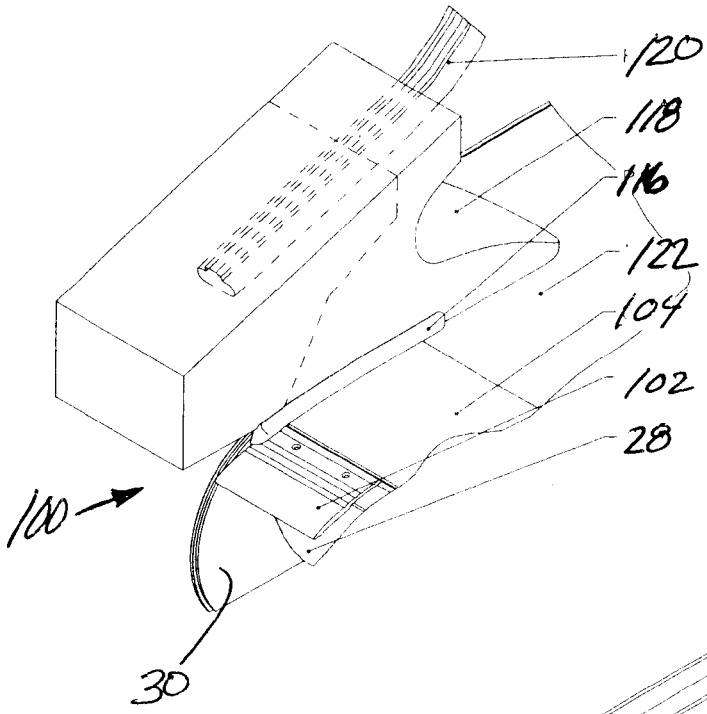
FIG. 7 illustrates another feature of this invention.

FIG. 6 illustrates another example implementation of this invention. In this example, a panel member 80 is associated with each step 24. More particularly, each panel member 80 preferably is associated with each drive chain link 40 so that the panel member 80 remains stationary relative to the drive chain link along the entire the escalator pathway. As can be appreciated from FIG. 6, there is some relative motion between the panel members 80 and associated steps 24 at the transitional zone of the escalator. Otherwise, the panel members 80 effectively remain stationary relative to each step 24 along the majority of the pathway.

In one example, the panel members 80 are secured to the drive chain links 40. In another example, the panel members 80 are formed as part of the drive chain links. The panel members 80 remain stationary relative to the drive chain links 40 along the entire loop traveled by the drive chain.

In this example, the panel members 80 each cover a corresponding triangular area bordered by the step tread surface 26, an adjacent riser surface 28 and the line between the step noses. The inventive arrangement makes it possible to provide a moving flange arrangement that does not present interface problems at the escalator comb.

Figure 8:
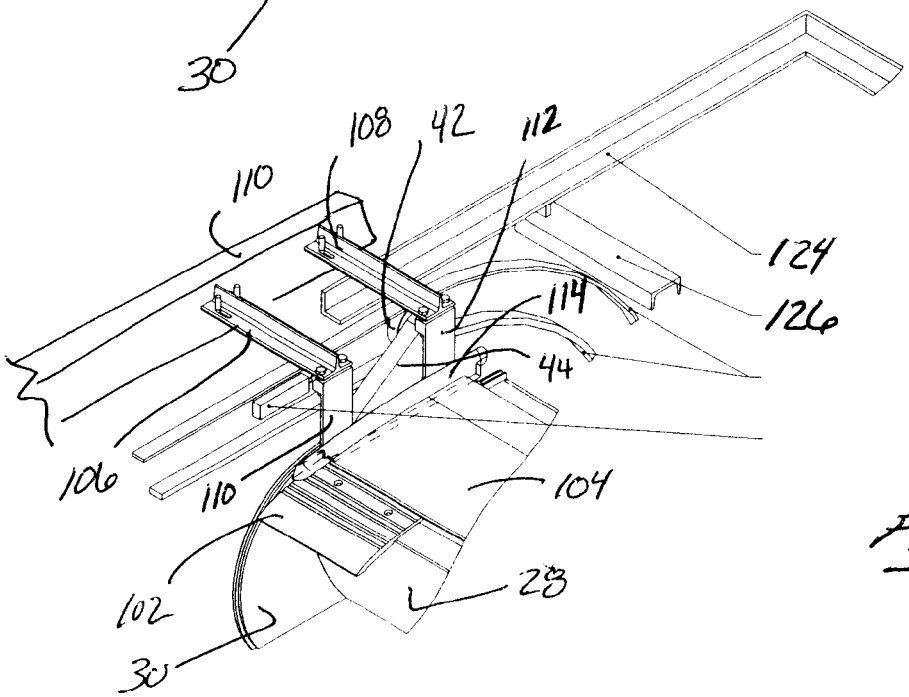
FIG. 8 illustrates more details of selected portions of the components shown in FIG. 7.

This invention includes a unique comb and combplate support arrangement that facilitates movement of the preferred arrangement through the transition zones at each landing of the escalator system. As seen in FIGS. 7 and 8, a combplate support assembly 100 allows the step flanges and the steps to move through the transition zones and interface with combs 102 and combplates 104 at each landing.

The support assembly 100 preferably includes two steel support members 106 and 108 that are supported on the escalator truss 110. The support members 106 and 108 preferably are horizontally oriented relative to the floor surface at the landing. Two vertical support members 110 and 112 preferably extend downward from ends of the support members 106 and 108, respectively. The support members 110 and 112 are connected to a support member 114 that provides support underneath the edges of the comb 102 and the combplate 104. The arrangement of the various support members permits the step flange members to pass beneath the support members and beside the comb 102 and combplate 104.

The edges of the combplate 104 preferably are at least partially covered by a plastic cover portion 116. A handrail entry device 118, which receives a handrail 120, preferably is adjacent the upper edge of the cover 116. The other landing components that are illustrated include a floorplate 122, which preferably is supported by a floorplate frame 124 and a support member 126 in a conventional manner.

The preceding description is exemplary rather than limiting in nature. Descriptive words such as horizontal, vertical, beneath and above were used in connection with the illustrations for discussion purposes and should not be considered a limitation on this invention. Moreover, variations and modifications to the disclosed examples may become apparent to those skilled in the art that do not necessarily depart from the spirit or scope of this invention. The scope of legal protection given to this invention can only be determined by studying the following claims.

What is claimed is:

1. An escalator system comprising:

a plurality of steps that are adapted to be moved in a loop along a path;

at least one drive member associated with the steps;

at least one panel member adjacent each step and supported by the drive member such that the panel member remains stationary relative to the drive member along the entire path and establishes a barrier at least along one edge of the escalator.

2. The system of claim 1, including two panel members associated with each step, one panel member adjacent a first edge of the step and another panel member at an opposite edge of the step.

3. The system of claim 1, wherein the panel member is rigidly secured to the drive member.

4. The system of claim 1, wherein the panel member is formed as a portion of the drive member.

5. The system of claim 1, wherein the drive member includes a plurality of links having at least one link associated with each step, respectively, and wherein each panel member remains stationary relative to a corresponding one of the links.

6. The system of claim 1, including a first panel portion that remains stationary relative to the step and a second panel portion that remains stationary relative to the drive member and wherein the first panel portion includes an interface surface and each second panel portion includes a corresponding interface surface that cooperates with at least a portion of the first panel portion interface surface.

7. The system of claim 6, including a cover extending over at least a portion of an interface between the first panel portion and the second panel portion.

8. A step flange assembly for all escalator having a plurality of steps that move along a path, comprising:

a first rigid panel member adjacent an edge of each step that remains stationary relative to the step; and a second rigid panel member that cooperates with the first panel member and moves with the first panel member while permitting relative movement between the first and second panel members.

9. The assembly of claim 8, including a plurality of first panel members interspaced with a plurality of second panel members to form a continuous barrier along an edge of the steps of the escalator, each first panel member including an interface surface along one edge and each second panel member including two interface surfaces that cooperate with adjacent first panel members.

10. The assembly of claim 9, including a groove along one of the cooperating interface surfaces that receives a corresponding portion of the other of the cooperating interface surfaces.

11. An escalator system, comprising:

a plurality of steps that are adapted to move along a path;

a drive member that moves with the steps along the path; and a plurality of panel members that are supported by the drive member, remain stationary relative to the drive member and move with the steps along the path.

12. The system of claim 11, including a first panel portion that remains stationary relative to the step and a second panel portion that remains stationary relative to the drive member and wherein the first panel portion includes an interface surface and each second panel portion includes a corresponding interface surface that cooperates with at least a portion of the first panel portion interface surface.

13. The system of claim 11, wherein the drive member comprises a drive chain having a plurality of links with at least one link associated with each step.

14. The system of claim 13, wherein the panel members are secured to corresponding ones of the links.

15. The system of claim 13, wherein the panel members are formed as part of corresponding ones of the links.

16. An escalator system comprising:

a plurality of steps that are adapted to be moved in a loop along a path;

at least one drive member associated with the steps;

at least one panel member adjacent each step that is rigidly secured to the drive member such that the panel member remains stationary relative to the drive member along the entire path and establishes a barrier at least along one edge of the escalator.

17. The system of claim 16, wherein the drive member includes a plurality of links having at least one link associated with each step, respectively, and wherein each panel member remains stationary relative to a corresponding one of the links.

18. The system of claim 16, including a first panel portion that remains stationary relative to the step and a second panel portion that remains stationary relative to the drive member and wherein the first panel portion includes an interface surface and each second panel portion includes a corresponding interface surface that cooperates with at least a portion of the first panel portion interface surface.

19. The system of claim 18, including a cover extending over at least a portion of an interface between the first panel portion and the second panel portion.

20. A step flange assembly for an escalator having a plurality of steps that move along a path, comprising:

a plurality of first panel members adjacent an edge of each step that remains stationary relative to each corresponding step; and a plurality of second panel members that cooperate with the first panel members and move with the first panel members while permitting relative movement between the first and second panel members, the first panel members being interspaced with the plurality of second panel members to form a continuous barrier along an edge of the steps of the escalator, each first panel member including an interface surface along one edge and each second panel member including two interface surfaces that cooperate with adjacent first panel members.

21. The assembly of claim 20, including a groove along one of the cooperating interface surfaces that receives a corresponding portion of the other of the cooperating interface surfaces.

22. An escalator system, comprising:

a plurality of steps that are adapted to move along a path;

a drive member comprising a drive chain having a plurality of links with at least one link associated with each step, the drive member moving with the steps along the path; and a plurality of panel members that are secured to corresponding ones of the links such that the panel members remain stationary relative to the drive member and move with the steps along the path.

23. The system of claim 22, including a first panel portion that remains stationary relative to a corresponding one of the steps and a second panel portion that remains stationary relative to a corresponding one of the drive chain links and wherein the first panel portion includes an interface surface and each second panel portion includes a corresponding interface surface that cooperates with at least a portion of the first panel portion interface surface.

* * * * *